US005395046A

United States Patent [19]

Knobbe et al.

[11] Patent Number: 5,395,046

[45] Date of Patent: Mar. 7, 1995

[54] HAND-HELD SPRAY GUN WITH REPLACEABLE HANDLE

[75] Inventors: Alan J. Knobbe, Amherst; Gerald W. Crum, Elyria; Curtis B. Haller, Lorain, all of Ohio

[73] Assignee: Nordson Corporation, Westlake, Ohio

[21] Appl. No.: 142,200

[22] Filed: Oct. 25, 1993

[51] Int. Cl.[6] ..... B05B 5/047; B05B 15/00

[52] U.S. Cl. ..... 239/3; 239/690; 239/704; 239/706; 239/289; 239/526; 239/530

[58] Field of Search ..... 239/3, 690, 696, 697, 239/704, 705, 706, 707, 708, 289, 525, 526, 530

[56] References Cited

U.S. PATENT DOCUMENTS

| | | | |
|---|---|---|---|
| 4,401,275 | 8/1983 | Ruud | 239/704 |
| 4,597,534 | 7/1986 | Ruud | 239/704 |
| 4,798,338 | 1/1989 | Bauch et al. | 239/706 X |
| 4,886,215 | 12/1989 | Ruud | 239/526 X |
| 4,979,680 | 12/1990 | Bauch et al. | 239/706 X |
| 5,056,720 | 10/1991 | Crum et al. | 239/698 |
| 5,064,123 | 11/1991 | Aiello et al. | 239/526 X |
| 5,149,160 | 9/1992 | Iida et al. | 239/525 |
| 5,236,129 | 8/1993 | Grime et al. | 239/528 |

FOREIGN PATENT DOCUMENTS

| | | | |
|---|---|---|---|
| 9211950 | 7/1992 | WIPO | 239/704 |

*Primary Examiner*—William Grant

*Attorney, Agent, or Firm*—Rankin, Hill, Lewis & Clark

[57] ABSTRACT

A hand-held powder spray gun includes a wand type handle that extends from the top of the handle and away from the rear of the gun, which provides for ergonomic operation of the gun. The wand handle can be converted to a pistol handle by removal of the handle from the gun body. The parts of the wand handle and the pistol handle are interchangeable to facilitate conversion and repair. The wand handle can be used with a diffuser having hose connections extending from the rear of the spray gun to make the gun easier to operate when held from above. A diffuser having hose connections at the bottom is also provided for use with a pistol type handle.

28 Claims, 4 Drawing Sheets

HAND-HELD SPRAY GUN WITH REPLACEABLE HANDLE

BACKGROUND OF THE INVENTION

1. Field of the Invention

This invention relates to electrostatic powder painting, and more particularly to the configuration of spray guns used for hand spraying.

2. Description of the Prior Art

In electrostatic powder painting, dry paint particles are fluidized in a powder hopper and pumped through a hose to a spray gun which sprays the powder onto anitem or part to be coated. The spray gun typically charges the powder in one of two ways—either the gun has a high voltage charging electrode, or the gun has means to charge the powder by friction, i.e., tribo-electrically. This invention relates to both types of spray guns but will be described with respect to tribo-electric type powder spray guns.

Generally, in tribo-electric powder guns, the powder is epoxy based, and surfaces are provided within the gun, typically constructed from polytetrafluoroethylene (PTFE), which the powder particles impact numerous times to frictionally charge the particles. When the powder particles are sprayed from the front of the gun, they are electrostatically attracted to the product to be painted which is generally electrically grounded. Once these electrostatically charged powder particles are deposited onto the part, they adhere there by electrostatic attraction until they are conveyed to an oven where they are melted to flow together to form a continuous coating on the part. Powder coating generally provides a tough and durable finish such as would be found on many appliances, garden furniture, lawn mowers, and other products.

Electrostatic powder spraying can be performed either automatically or manually. Automated powder spraying is often preformed on production lines in which the part to be sprayed is conveyed through a spray booth, and automatically controlled spray guns, which are mounted at fixed positions, on robots or gun movers, at appropriate locations in the spray booth, spray the powder onto the parts in accordance with a preset automated program. Manual powder spraying is usually performed by one or more operators who hold the spray gun in their hands and spray the powder on to the parts by hand. Effective manual powder spraying relies upon the skill of the operators and their ability to visually observe where the powder should be sprayed and their ability to operate the spray gun to deposit the powder in the desired locations on the parts.

U.S. Pat. No. 5,344,082 shows an improved tribo-electric powder spray gun which is used in automated spraying operations. This gun is available as a Tribomatic TM II gun from Nordson Corporation. In this gun, an improved powder flowpath is provided using the arrangement of a core within a sleeve, wherein the powder flowpath is provided between the exterior of the core and the interior of the sleeve. The exterior of the core and the interior of the sleeve are provided with undulating or wavy PTFE surfaces, so that an annular wavy flowpath for the powder is provided within the gun. This causes the powder to change direction and contact the PTFE charging surfaces numerous times while passing through the charging portion of the gun, with the powder particles picking up charge on each contact. The exterior of the core and interior of the sleeve are held to a close tolerance so that the powder flowpath is very narrow, further increasing the number of times each powder particle hits a charging surface. The core can be easily inserted into and removed from the sleeve for assembly and repair, and this removability is accomplished by dimensioning the diameter of the peaks or ridges of the inner core to be less than or at most equal to the diameter of the peaks or ridges of the outer sleeve. In addition, the wear sleeves on both the inner core and the outer sleeve are longitudinally symmetrical, so that the gun can be re-assembled with either end of the wear sleeves inserted first. A diffuser is provided at the rear of the gun to control the charge on the powder by driving the powder through the charging portion at the desired velocity.

The automated spray gun in U.S. Pat. No. 5,344,082 also provides a simplified grounding path that avoids the time consuming and complicated manufacturing process by incorporating a ground ring at the beginning of, but outside of, the powder flowpath. By placing the ground ring outside of the flowpath, the ground ring is kept clean. In addition, by placing the ground ring at the inlet to the charging portion of gun, the ground ring is located where the greatest rate of charging occurs, and this location is the ideal place to bleed off charge.

These features are disclosed in U.S. Pat. No. 5,344,082 in connection with an automatic spray gun. There is a need for a spray gun having these features that can be hand held and used for manual spraying as well as a need for improved manual spray guns generally.

Hand-held powder spray guns have traditionally been configured in a design resembling a pistol with a handle extending downwardly from the body of the spray gun. The operator grips the handle as he would a pistol and points the charging portion or barrel of the spray gun at the part to be sprayed. While the pistol handle configuration has long been used for powder spray guns, it may not be ergonomically appropriate when the spray gun is used in certain positions by the operator. For example, when the operator is spraying a portion of the part down low in the spray booth, he must hold the pistol handle spray gun even lower, and this awkward position may make it exceeding difficult to spray effectively. Depending upon the skills of the operator, the spraying of the lower portion of the part may lack proper quality due to the inability of the operator to perform proper spraying when using the gun in such awkward positions.

In addition, there is a need for automatic spray guns which can be quickly and easily converted to manual spray guns having ergonomically designed handles to facilitate operator comfort.

SUMMARY OF THE INVENTION

The present invention provides a manually operated powder spray gun which has advantages not provided by the prior art. The spray gun of the present invention in one preferred embodiment includes a wand type handle which extends from the top of the body of the spray gun so that the spray gun may be held from above.

The wand type handle on the spray gun of this invention provides a technique for holding and operating the spray gun ergonomically which should allow the operator to use the spray gun for longer periods of time with less fatigue. In addition, by holding the gun from above, it is easier for the operator to spray parts that are positioned lower in the spray booth. When used by operators lacking expert skills in spraying in lower positions, the use of the spray gun having a wand type handle should produce better quality spraying of items.

The wand handle extends at an angle away from the rear of the gun, forming an acute angle with the spray gun barrel, so that the handle can be more easily gripped by the operator. The angle at which the handle extends is chosen to facilitate the aiming of the spray gun by the operator when held from above. Specifically, when the spray gun is held at a nominal distance from the part being sprayed, an imaginary line from the operator's eyes to the handle extends to the area at which powder is sprayed onto the part.

Because of the ergonomic advantages of using a spray gun with a wand type handle in accordance with the present invention, it may be desirable to reconfigure the coating operation so that the parts to be sprayed are in a lower position relative to the operator. This would allow the operator to use the spray gun effectively and enjoy the ergonomic advantages of the position of the wand type handle.

However, if the spray booth is not reconfigured in this manner, it is likely that the operator will also be required to spray parts up high. The spray gun having the wand type handle may be suitable for use in spraying these parts in many instances, but the operator may desire to use a spray gun with a pistol type handle in these situations.

While the operator may be provided with two guns, one with a wand type handle for routine use and especially for use in spraying parts low in the booth, and another with a pistol type handle for spraying parts high in the booth, the present invention also provides the ability to easily convert a spray gun with a wand handle to a spray gun with a pistol handle and vise versa. In accordance with the present invention, the wand handle is easily removable from the gun body by removing only a few fasteners, and it can be replaced by a pistol handle that attaches to the gun body in the same manner. In addition, all of the components of the wand handle, including the trigger and the switch, but excluding the handle body, are fully interchangeable with the wand handle and the pistol handle, simplifying conversion and use and allowing replacement parts to fit either version of the gun.

The present invention also in the preferred embodiment provides the advantages of the automated gun that uses the sleeve and core with undulating or wavy interior surfaces, and provides these advantages in a hand-held powder gun.

Likewise, the hand-held spray gun of the present invention in the preferred embodiment uses the simplified grounding path that was only available before in an automatic spray gun.

The spray gun of the present invention is provided with a diffuser at the rear of the spray gun. In the version of the gun having the wand handle, the electrical cable extends from the handle away from the rear of the gun, and the diffuser hose connections for both the air hose and the powder conveying hose also extend away from the rear of the gun. This positioning of the cable and hose connections allows the spray gun to be used more easily when the gun is held from above since the cable and the hoses do not get in the operator's way.

When the spray gun of the present invention is converted from the wand handle to the pistol handle, an alternative diffuser may be used. The alternative diffuser is specially designed for use with the pistol handle with hose connections positioned so that both hoses extend downwardly from the rear of the gun. Since the pistol handle also extends downwardly, this diffuser configuration allows the hoses to be positioned in a convenient location for operation of the spray gun.

These and other advantages are provided by the present invention of a hand-held powder spray gun which in one preferred embodiment comprises a body having first and second ends, a diffuser for mixing powder with conveying air, the diffuser mounted at the first end of the body and forming the inlet end of the gun, a barrel extending from the second end of the body, the barrel including a charging path for the powder, a sprayhead mounted on the barrel opposite the body, the sprayhead forming the outlet end of the gun, and a wand handle for grasping and operating the gun, the handle attached to the body and extending upwardly from the body towards the spray head.

In accordance with another aspect of the present invention, an assembly is provided for converting the handle position of a hand-held powder spray gun from a pistol handle assembly mounted to a gun body and extending downwardly from the gun body toward the rear of the gun to a wand handle assembly mounted to the gun body and extending upwardly from the gun body away from the rear of the gun, or vise versa. The converting assembly comprising a handle assembly including a handle body for mounting to the gun body, means for mounting the trigger from the other handle assembly, and means for mounting the switch from the other handle assembly.

In accordance with yet another aspect of the present invention, a hand-held powder spray gun is provided which comprises a body having first and second ends, a barrel extending along an axis from the second end of the body, the barrel including a charging path for the powder, a sprayhead mounted on the barrel opposite the body, the sprayhead forming the outlet end of the gun, a handle attached to the body for grasping and operating the gun, and a diffuser for mixing powder with conveying air, the diffuser mounted at the first end of the body and forming the inlet end of the gun, the diffuser including a first hose connection for attachment to a powder supply hose and a second hose connection for attachment to a conveying air supply hose, the first and second hose connections each extending substantially parallel to each other and substantially parallel to the axis of the barrel of the gun or substantially perpendicular to the axis of the barrel of the gun.

DETAILED DESCRIPTION OF THE PREFERRED EMBODIMENT

Figure 1:
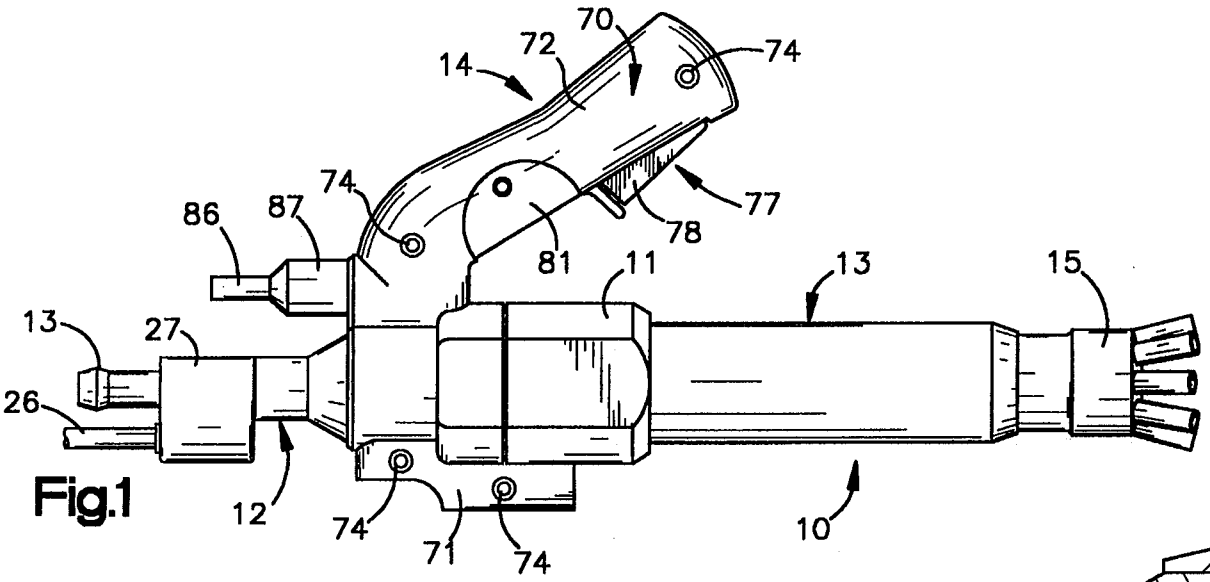
FIG. 1 is a side elevational view of one embodiment the powder spray gun of the present invention having the wand handle.

Referring more particularly to the drawings and initially to FIG. 1, there is shown a tribo-electric powder spray gun 10 according to the present invention. The gun 10 includes a body 11 with a diffuser 12 on one end and a barrel 13 on the other end, and a handle 14 secured to the body. A suitable sprayhead 15 is mounted at the outlet end of the barrel 13. The sprayhead 15 could be of various types in addition to the type shown, such as sprayheads producing conical or flat spray patterns. The gun body 11 has a central opening extending therethrough providing a flowpath for the powder, with the diffuser 12 mounted at the inlet end in the central opening and the components of the barrel 13 mounted at the outlet end of the central opening.

Figure 3:
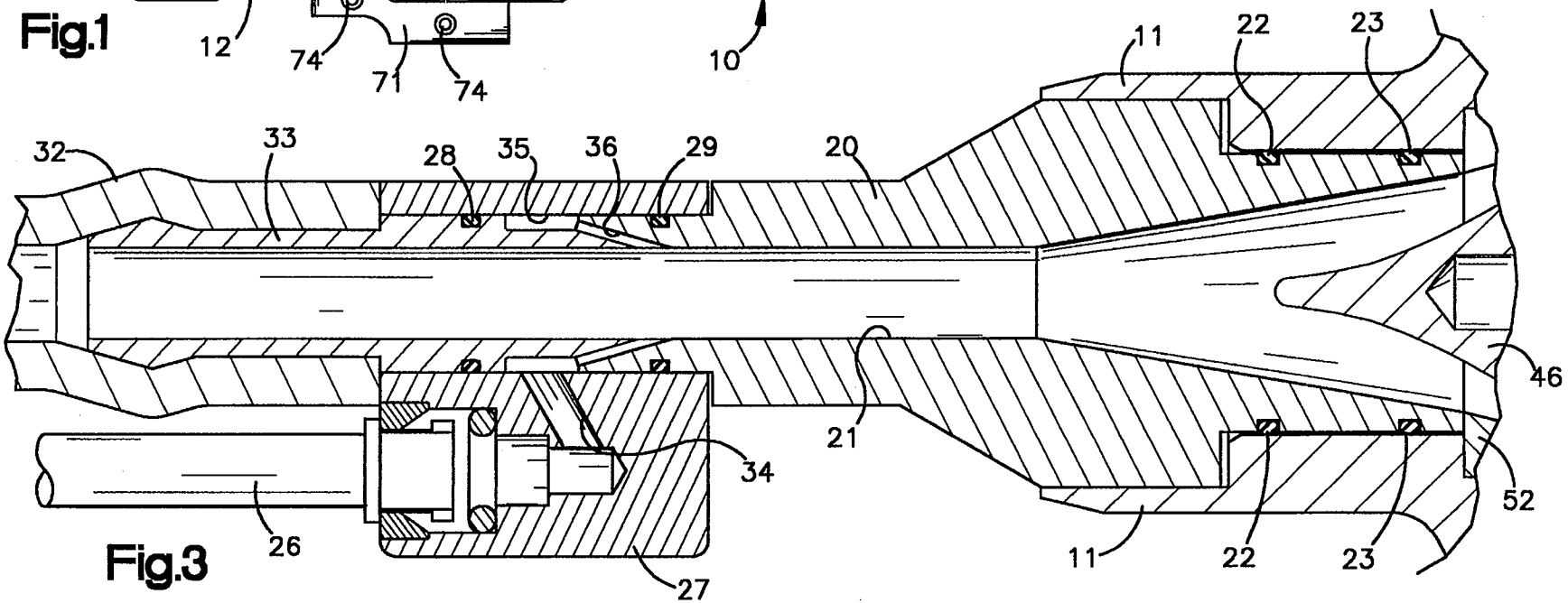
FIG. 3 is a detail of the diffuser portion of FIG. 2 to a larger scale.

As shown in FIG. 3, the diffuser 12 provides the means for mixing the powder to be sprayed with conveying air. The diffuser 12 comprises a diffuser body 20 having a central axial passageway 21. The diffuser body 20 is fitted into the inlet end of the central opening in the gun body 11, and O-rings 22 and 23 are provided in grooves around the outer surface of the diffuser body 20 between the diffuser body and the interior surface of the central opening in the gun body 11.

Compressed air enters the diffuser 12 through an air hose 26 attached to a connector 27. The connector 27, which is located on the end of the diffuser body 20, is mounted around the exterior of the diffuser body and is sealed to the diffuser body by O-rings 28 and 29. Powder from a hopper (not shown) is conveyed to the diffuser 12 by air flow from a pump (not shown). The powder and conveying air from the pump enter the spray gun through a feed hose 32 which is connected to the gun at an inlet connector 33 located on the end of the diffuser body 20. The diffuser air enters the diffuser 12 from the connector 27, and travels through a short passageway 34 in the connector 27 into a channel formed by circular groove 35 around the exterior of the diffuser body 20 where the diffuser body is covered by the connector 30. The diffuser air then travels through small diagonal nozzle channels 36 into the powder stream in the axial passageway 21. Diffuser air flowing through the nozzle channels 36 reduces the pressure just downstream of the powder inlet which assists the pump by drawing the powder from the powder feed hose into the diffuser.

Lower pressure in the diffuser results in less back pressure on the pump which in turn results in higher powder flow output from the pump. The high volume of diffuser air results in the powder being conveyed through the gun barrel 13 at high velocity further resulting in high charging of the powder. Since the magnitude of the charge imparted to the powder is directly related to the velocity of the powder through the gun, the volume of diffuser air is essentially the way of adjusting the charging of the powder: higher diffuser air produces a higher charge on the powder, lower diffuser air a lower charge. The present invention provides a diffuser in the back of the gun to control the charge on the powder by driving the powder through the gun barrel 13 at the desired velocity.

The gun barrel 13 provides the means for providing a tribo-electric charge to the powder, and this charge is produced by passing the powder through a flowpath having undulating or wavy PTFE surfaces, so that an annular wavy flowpath for the powder is provided within the gun barrel. The gun barrel 13 is essentially the same as that disclosed in U.S. Pat. No. 5,344,082, the disclosure of which is hereby incorporated by reference in its entirety.

The gun barrel 13 includes an outer extension tube 40, which is removably attached to the gun body 11 and which extends from the forward end of the body, an outer sleeve assembly 41 located within the outer extension tube 40, and an inner core assembly 42 mounted within the outer sleeve assembly 41.

Figure 2:
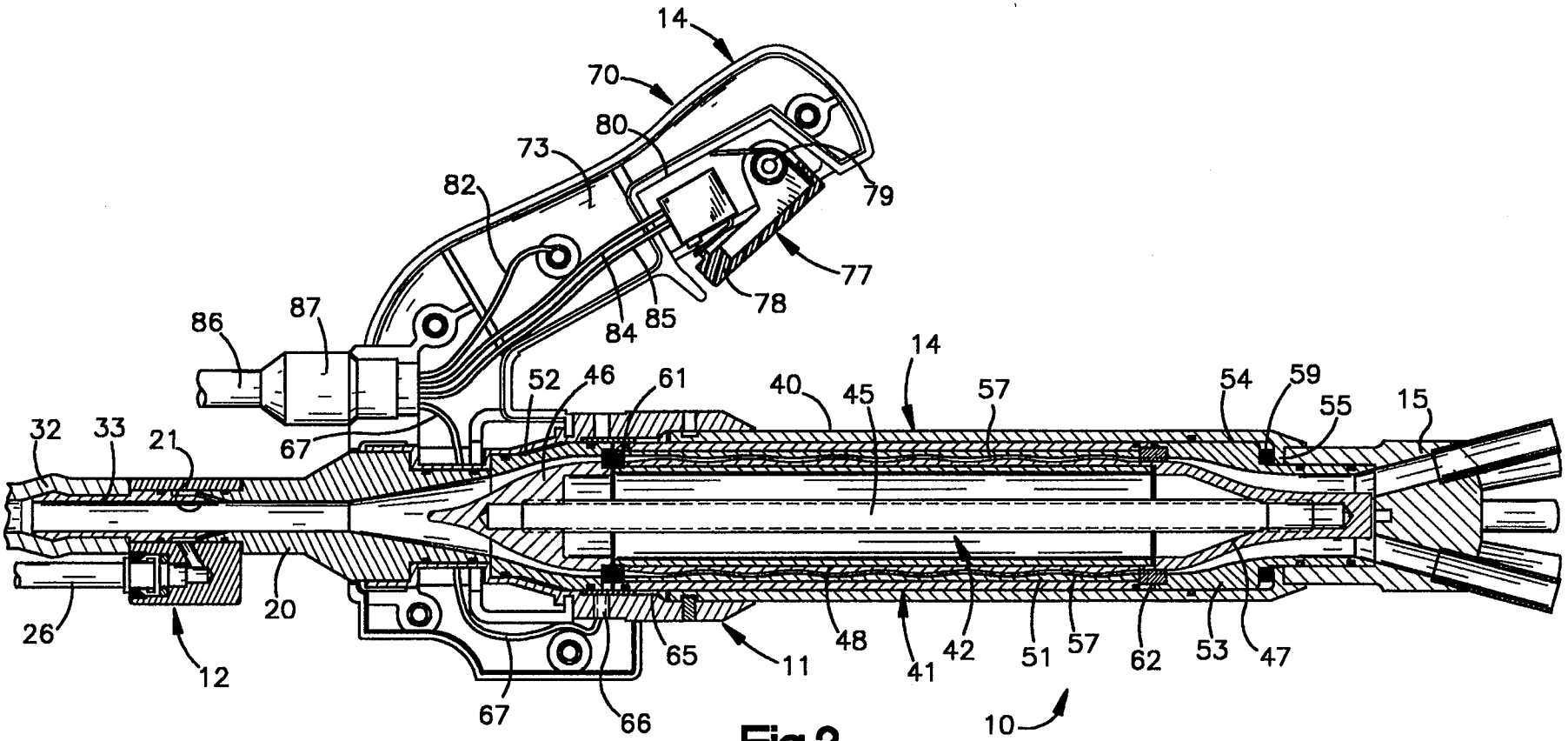
FIG. 2 is a side sectional view of the spray gun of FIG. 1.

As shown in FIG. 2, the inner core assembly 42 comprises a central threaded rod 45, having a generally conical inlet distributor 46 threaded on one end, and a generally frusto-conical outlet distributor 47 threaded on the other end. A generally cylindrical inner wear sleeve 48 is captured between the inlet distributor 46 and the outlet distributor 47.

The outer sleeve assembly 41 is mounted within the extension tube 40 and comprises an outer wear sleeve 51 which is captured between an inlet wear sleeve 52 and an outlet wear sleeve 53. The outlet wear sleeve 53 has a shoulder 54 around its exterior, and the outlet end of the extension tube 40 has a flange 55 which extends radially inwardly to engage the shoulder 54 and hold the outlet wear sleeve in place.

Thus, the inlet wear sleeve 52 is positioned around the inlet distributor 46, the outer wear sleeve 51 is positioned around the inner wear sleeve 48, and the outlet wear sleeve 53 is positioned around the outlet distributor 47.

An annular gap 57 is formed between the inner and outer wear sleeves 48 and 51. The outer surface of the inner wear sleeve 48 and the inner surface of the outer wear sleeve 51 undulate, so that the annular gap 57 provides a tortuous path for the powder passing through the gun barrel 13. Specifically, the outer diameter of the inner wear sleeve 48 increases at generally the same longitudinal position that the inner diameter of the outer wear sleeve 51 increases, and the outer diameter of the inner wear sleeve 48 decreases at generally the same longitudinal position that the inner diameter of the outer wear sleeve 51 decreases, so that a narrow "wavy" flowpath for the powder is created by the annular gap 57 between the sleeves 48 and 51. The width of the annular gap 57 remains generally constant along the length of the inner and outer wear sleeves 48 and 51, although the annular gap 57 varies in diameter.

Powder enters the gun barrel 13 from the diffuser 12 and is channelled into the annular gap 57 between the inner and outer wear sleeves 48 and 51 by the converging surfaces of the inlet wear sleeve 52 and the inlet distributor 46. The inlet wear sleeve 52, which is positioned within the gun body 11, extends from the outer wear sleeve 51 to the diffuser body 20 and defines a passage for the powder exiting the diffuser 12.

The powder then flows through the narrow, "wavy" annular gap 57 and subsequently through a widening annular gap defined by the diverging surfaces of the outlet distributor 47 and the outlet wear sleeve 51 from which the powder is discharged into the sprayhead 15.

The extension tube 40 is removably attached to the gun body 11 by a bayonet-type latching mechanism, so that the gun barrel 13 is securely held to the gun body during use and may be easily removed when it is desired to clean the gun or replace one of the wear sleeves.

With the extension tube 40 securely attached to the gun body 11 by the bayonet mechanism, the outer wear sleeve 51 is urged into sealing engagement with the central opening in the body 11 by a silicone rubber gasket 59 located between the outer flange 55 of the extension tube and the shoulder 54 of the outlet wear sleeve 53. The gasket 59 is compressible and resilient, and it forms a spring which provides a force upon the outer wear sleeve 53 toward the gun body 11.

The position of the inner core assembly 42 with respect to the outer sleeve assembly 41 is maintained by a positioning ring 61 and a spacing ring 62. The positioning ring 61 is used both to align the inner wear sleeve 48 radially with the inlet distributor 46 at the inlet of the gun barrel 13 and to align the inner wear sleeve 48 and the distributors 46 and 47 axially with the outer wear sleeve 51 and the wear sleeves 52 and 53. The spacing ring 62 is used only to align the inner wear sleeve 48 and the outlet distributor 47 radially with the outer wear sleeve 51 and the outlet wear sleeve 53 at the outlet of the gun barrel 13.

The positioning ring 61 is located between the inlet wear sleeve 52 and the outer wear sleeve 51 and between the inlet distributor 46 and the inner wear sleeve 48. A small recess is formed around the inner surface of the inlet wear sleeve 52 adjacent to the outer wear sleeve 51 to provide for the positioning ring 61. Another similar recess is formed around the inner surface of the outer wear sleeve 51 adjacent to the inlet wear sleeve 52. Corresponding recesses are also formed in the outer surfaces of the inlet distributor 46 and the inner wear sleeve 48. The recesses provide for precise axial placement of the positioning ring 61 with respect to the outer sleeve assembly 41 and the inner core assembly 42.

The spacing ring 62 is located between the outer wear sleeve 51 and the outlet wear sleeve 53. A recess is formed in the outer wear sleeve 51 at the outlet edge, and a corresponding recess is formed in the outlet wear sleeve 51. The spacing ring 62 fits within the groove formed by these recesses. The spacing ring 62 engages the outer wall of the outlet distributor 47 to radially position the outer sleeve assembly 41 with respect to the inner core assembly 42.

In accordance with conventional design of tribo-electric powder spray guns, a portion of the gun barrel 13 is grounded to enhance the charging of the powder and promote safety by preventing the gun from storing a capacitive charge which could shock and injure the operator. The ground configuration of the gun of the present invention includes a ground ring 65 which is located within the gun body 11 and around the exterior of the inlet wear sleeve 52 and the outer wear sleeve 51, near the inlet of the gun barrel 13 where the highest charge transfer to the powder occurs. The ground ring 65 is located away from the powder flowpath, so that it is kept clean, resulting in a good, consistent electrical ground. The electrical grounding of the elements of the gun barrel 13 is accomplished by surface conduction along the inner walls of the inner wear sleeve 48, the outer wear sleeve 51, the inlet wear sleeve 52, the inlet distributor 46, the outlet distributor 47, and the outlet wear sleeve 53. From the ground ring 65, the current flows through a ground stud 66 to a gun ground wire 67 (later described) which is attached to the ground stud 66. The surface conductivity of the PTFE, the length of the path to the ground ring 65 and the electrical potential of the charge on the powder contact surfaces are all variables considered in the design of the gun for proper grounding and optimum charging performance.

The outlet end of the gun barrel 13 is designed to accept various conventional sprayheads. The sprayhead 15 which is shown to illustrate the mounting of a sprayhead to the outlet end of the gun barrel 13. The sprayhead 15 is mounted on the outlet wear sleeve 53 adjacent to the flange 55 on the outlet end of the extension tube 40.

As shown in FIGS. 1 and 2, the spray gun handle 14 is a "wand style" handle instead of a conventional "pistol style" handle. The handle 14 comprises a handle body 70 which includes an attachment portion 71 designed to fit around the exterior of the gun body 11 to secure the handle to the gun. The handle body 70 is preferably formed of two hollow molded plastic members 72 and 73 which are attached together using fasteners such as screws 74. The body members 72 and 73 are arranged in a "clam shell" fashion to form the handle body 70, and the screws 74 pass through the body member 72 and thread into internally threaded apertures in the body member 73. The lower portion of the members 72 and 73 form the attachment portion 71 and are configured so as to fit tightly around the gun body 11. The shape of the attachment portion 71 matches the exterior shape of the gun body 11 so that the handle body members fit tightly around the gun body and are firmly secured to the gun.

The handle body 70 extends upwardly from the gun body 11, so that the operator can grip and hold the spray gun from above. The operator thus holds the spray gun 10 in a position which is normally below the operator's elbows. This provides an ergonomic configuration for spraying many items in the spray booth, particularly those items in the lower portion of the booth. The handle body 70 extends at a angle toward the front of the spray gun, so that the handle 14 and the barrel 13 form an acute angle with each other. The angle between the handle 14 and the barrel 13 of the gun is chosen to facilitate the aiming of the gun when the operator holds the gun from above. Preferably, an imaginary line from the operator's eyes through the handle 14 will intercept the part being sprayed at the point at which the gun is spraying the part when the gun is spaced a nominal distance from the part. This configuration assists the operator in aiming the gun while the gun is being held in the lower wand-style position instead of in a pistol position.

As shown in FIG. 2, the handle includes a trigger 77 which is used to operate the gun. The trigger 77 is formed by an inverted L-shaped pivoting trigger member 78 which is mounted at the free end of its base about a pivot pin 79 which is anchored between the handle body members 72 and 73. When the trigger 77 is actuated, the trigger member 78 engages an electrical switch 80 located within the handle. The trigger 77 is positioned at the top of the handle so that it can be engaged by the operator's index finger when the operator holds the handle in a normal position. The handle 14 also includes an operator grounding pad 81 which is in contact with the operator's hand when the operator grasps the handle for grounding the operator so that the gun can be operated safely. The operator grounding pad 81 is connected to an operator ground wire 82 which extends from an electrical cable 86 which is connected to the handle 14.

The switch 80 is connected to insulated conducting leads 84 and 85 extending from the cable 86. The end of the cable 86 has a collar 87. The collar 87 is secured by annular flanges and recesses in an aperture at the lower end of the handle 14. The conducting leads 84 and 85 extend to the switch 80 which is operated by the inverted L-shaped pivoting trigger member 78. The cable 86 also includes the gun ground wire 67 which is attached to the ground stud 66 as described above. The gun ground wire 67 conducts current from the ground stud 66 through an ammeter in the control panel (not shown) to ground. The gun ground wire 67 not only grounds the barrel 13 but provides a measurement of the current being generated from the charging of the powder in the barrel.

The diffuser 12 shown is specially adapted for use with the wand handle 14. In particular, the diffuser 12 is designed so that the hoses 26 and 32 that extend from the diffuser extend from the rear of the spray gun rather than from the bottom of the gun. This facilitates the operation of the gun when it is held in the lower position by the operator using the wand handle 14.

While the wand handle 14 shown in FIG. 1 is advantageous for many applications, there are certain applications in which a conventional pistol handle would be more desirable. For example, when spraying pieces that are high above the operator, the operator must hold the gun up in the air to achieve desired results. Using the spray gun 10 of FIG. 1 with the handle 14 extending from the top of the gun would make such spraying operations difficult, and a conventional pistol handle may be more desirable in such instances, It may be possible for an operator to have two different guns available: the gun with the wand handle 14 of FIG. 1 for most spraying operations, and another gun with a pistol handle for operations in which it is needed.

Figure 4:
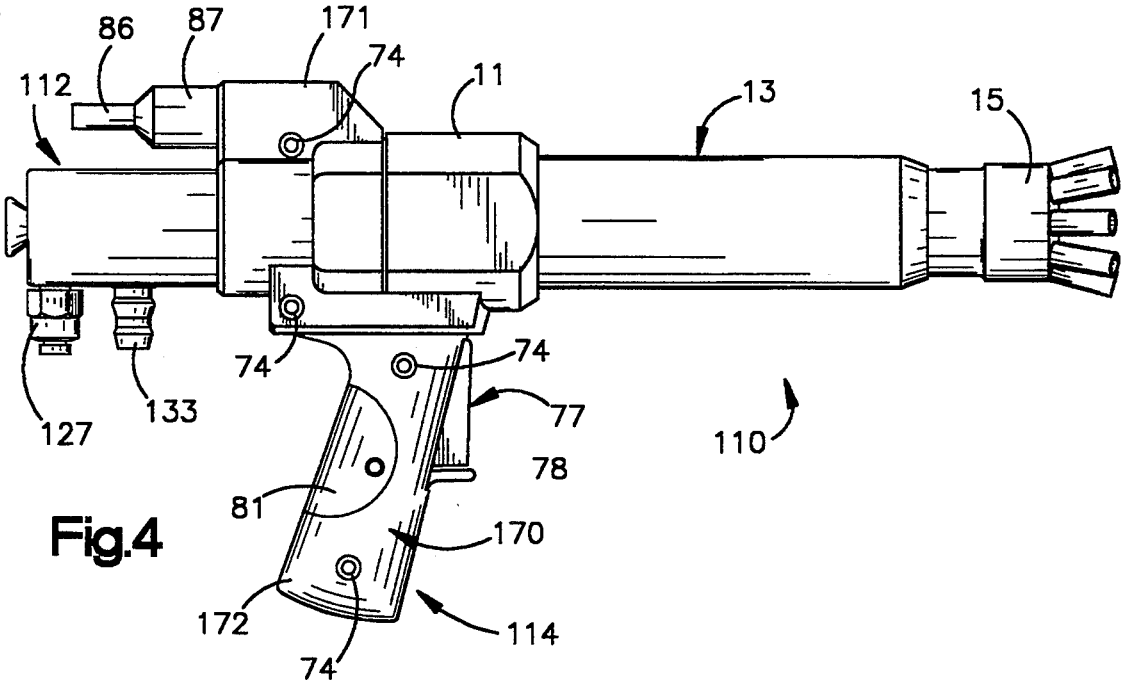
FIG. 4 is a side elevational view, similar to FIG. 1, of another embodiment of the powder spray gun of the present invention having the pistol handle.

The present invention, however, provides convertability so that the spray gun 10 with the wand handle 14 of FIG. 1 can be converted to a spray gun with a pistol handle by simply changing the handle body. This permits the users to vary the number of wand style guns and pistol style guns in their paint shops to their particular needs at any time simply by converting the handle. The converted spray gun 110 is shown in FIG. 4. The spray gun 110 of FIG. 4 has almost all of the same elements as the spray gun 10 of FIG. 1. The spray gun 10 has a body 11 with a barrel 13 mounted on one end to provide the charging path for the powder, and a sprayhead 15 mounted on the outlet end of the barrel 13. The gun barrel 13 is the same as the barrel already described with reference to FIG. 2. The gun 110 has a diffuser 112 mounted on the other end of the body 11. The diffuser 112 differs somewhat from the diffuser 12, as will be described in more detail below. Instead of the wand handle 14, a pistol handle 114 is attached to the gun body.

The pistol handle 14 is similar in construction to the wand handle 14 already described, except that it is formed of a handle body 170 which is formed of two members 172 and 173 having a different configuration than the wand handle body elements 72 and 73 and which includes an attachment portion 171 designed to fit around the exterior of the gun body 11. The handle body 170 is mounted so as to extend from the bottom of the gun body 11. The handle body members 172 and 173 are attached together with by four screws 74 which pass through the body member 172 and thread into internally threaded apertures in the body member 173.

The body members 172 and 173 of the pistol handle 114 are adapted to use the same trigger member 78, the same switch 80, and the same operator grounding pad 81 as used with the wand handle 14. As shown in FIG. 4, the handle 114 includes the trigger 77 formed by the inverted L-shaped pivoting trigger member 78 mounted at the free end of its base about the pivot pin 79 which is anchored between the handle body members 172 and 173. When the trigger 77 is actuated, the trigger member 78 engages the electrical switch 80 located between the handle body members 172 and 173. The trigger 77 is positioned at the top of the handle adjacent to the gun body 11 so that it can be engaged by the operator's index finger when the operator holds the pistol handle in a normal position. The handle 114 also includes the operator grounding pad 81 which is in contact with the operator's hand when the operator grasps the handle for grounding the operator so that the gun can be operated safely.

Figure 6:
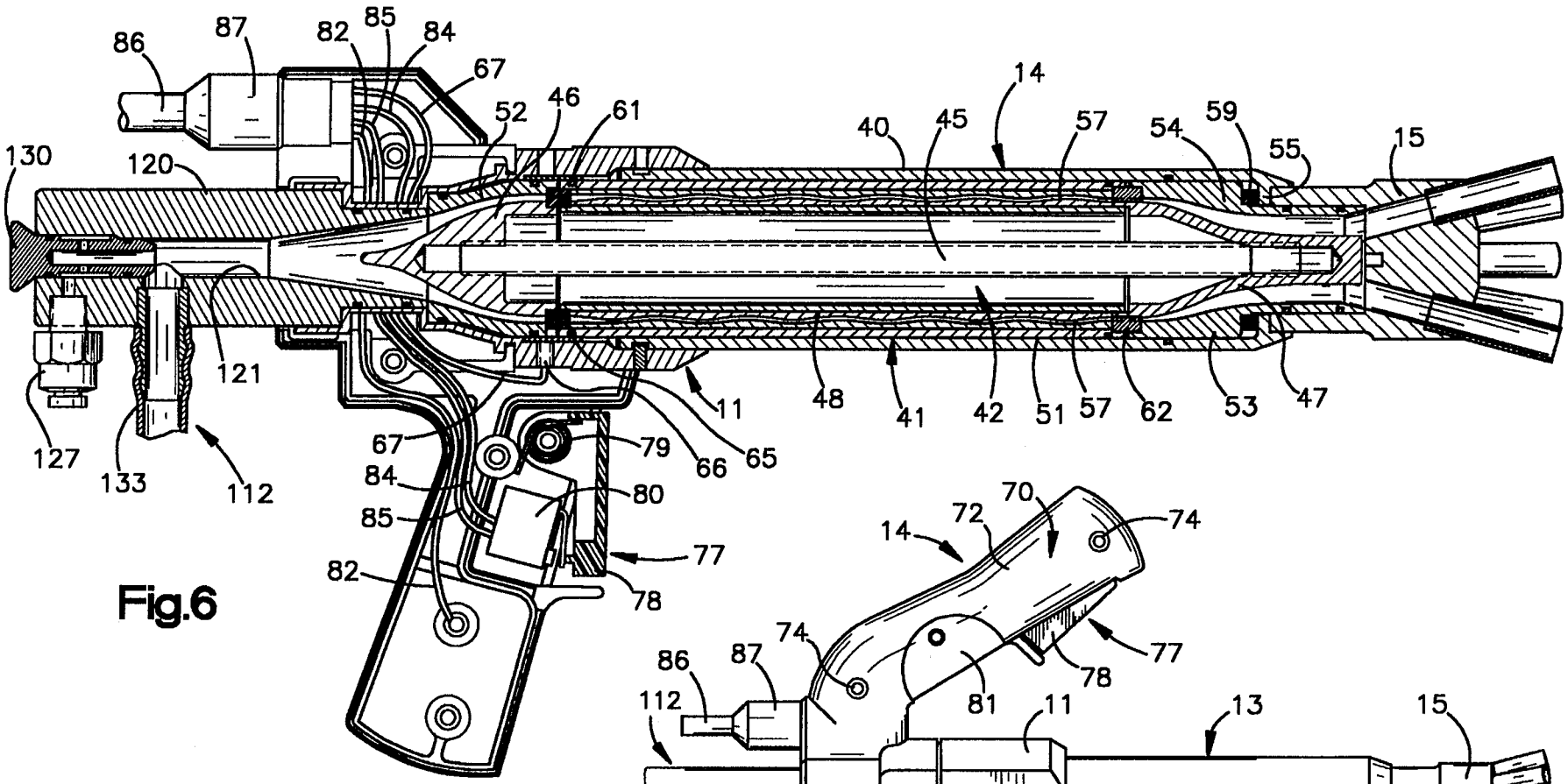
FIG. 6 is a side elevational view, partially in cross section, of the powder spray gun of FIG. 4.

The switch 80 is connected to the insulated conducting leads 84 and 85 extending from the electrical cable 86 which is connected to the handle. The end of the cable 86 is attached to the cable mounting collar 87. The operator ground wire 82, which also extends from the cable 86 is connected to the operator grounding pad 81 in the handle 14. The gun ground wire 67 which is connected to the ground stud of the barrel 13 also extends from the cable 86. Whereas, as shown in FIG. 2, in the wand style gun only the gun ground wire 67 passes between the handle body member 73 and the gun body 11 from under the body 11 to above the body 11, as shown in FIG. 6, in the pistol style gun all four wires 67, 82, 84 and 85 and pass from under the gun body 11 to above the body 11 between the handle body member 172 or 173 and the body 11.

While the diffuser 12 shown in FIG. 3 may be used with the gun 110 of FIG. 4, it is preferred that the diffuser 12 be replaced with a diffuser in which the hoses extend downwardly from the bottom of the diffuser rather than from the rear of the diffuser since the handle and the cable also extend from the bottom of the gun. Such a diffuser is provided by the diffuser 112 shown in FIG. 5 which has connections for both hoses at the bottom.

Figure 5:
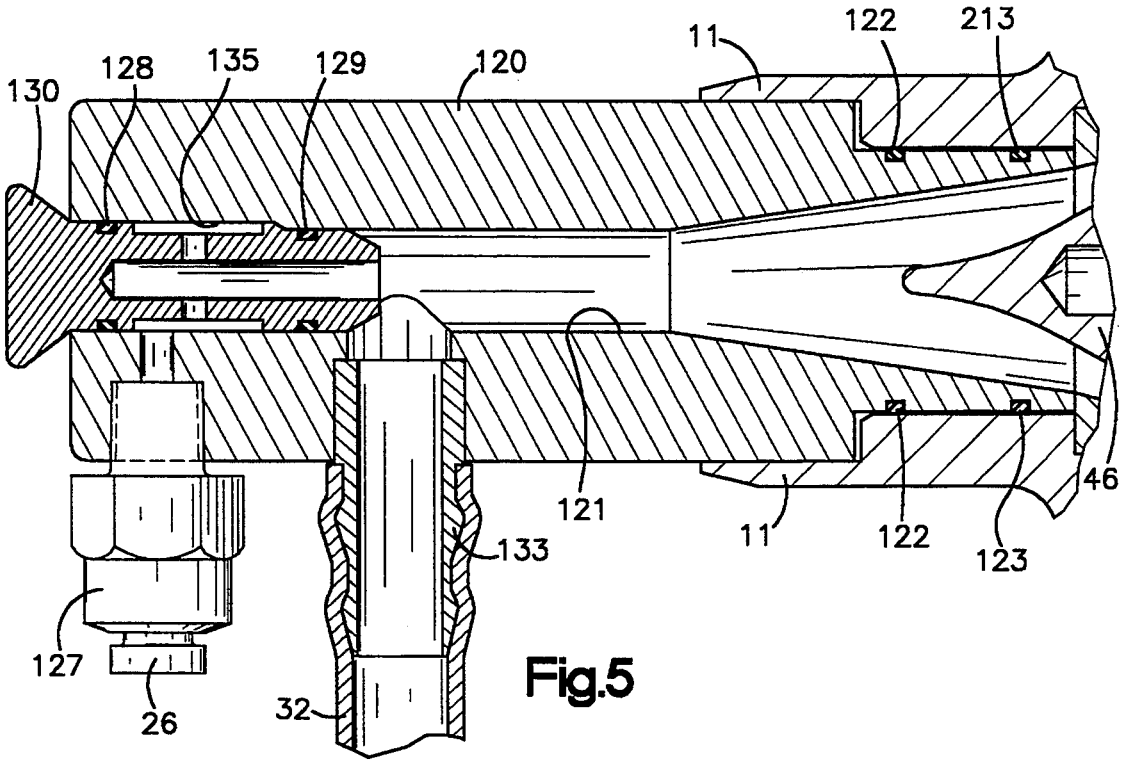
FIG. 5 is a detail side sectional view of the diffuser portion of the gun of FIG. 4 to a larger scale.

As shown in FIG. 5, the diffuser 12 comprises a diffuser body 120 having a central axial passageway 121. A diffuser nozzle 130 is inserted into the rear end of the passageway 121. The diffuser body 120 is fitted into the inlet end of the central opening in the gun body 11, and O-rings 122 and 123 are provided in grooves around the outer surface of the diffuser body 120, between the diffuser body and the interior surface of the central opening in the gun body 11.

Compressed air enters the diffuser 112 through an air hose 26 attached to a connector 127 located at the bottom of the diffuser. The connector 127 is connected to a radially extending passageway 131 in the diffuser body 120 which extends upwardly to the diffuser nozzle 130. Powder from a hopper is conveyed to the diffuser by flow air from the pump. The powder and conveying air enter the gun through a feed hose 32 which is connected to the gun at an inlet connector 133 which is also located at the bottom of the diffuser. The inlet connector 133 extends radially into the diffuser body 120 upwardly toward the passageway 121 next to the air inlet connector 127. As the powder enters the diffuser 112 from the connector 133, the powder is mixed with the diffuser air from the diffuser nozzle 130. Diffuser air flowing across the exit of the powder inlet connector 133 reduces the pressure at the powder inlet which assists the pump by drawing the powder from the powder feed hose into the diffuser 112. The hole in the nozzle 130 in the diffuser is sized to provide a high volume air flow at low pressure.

Figure 7:
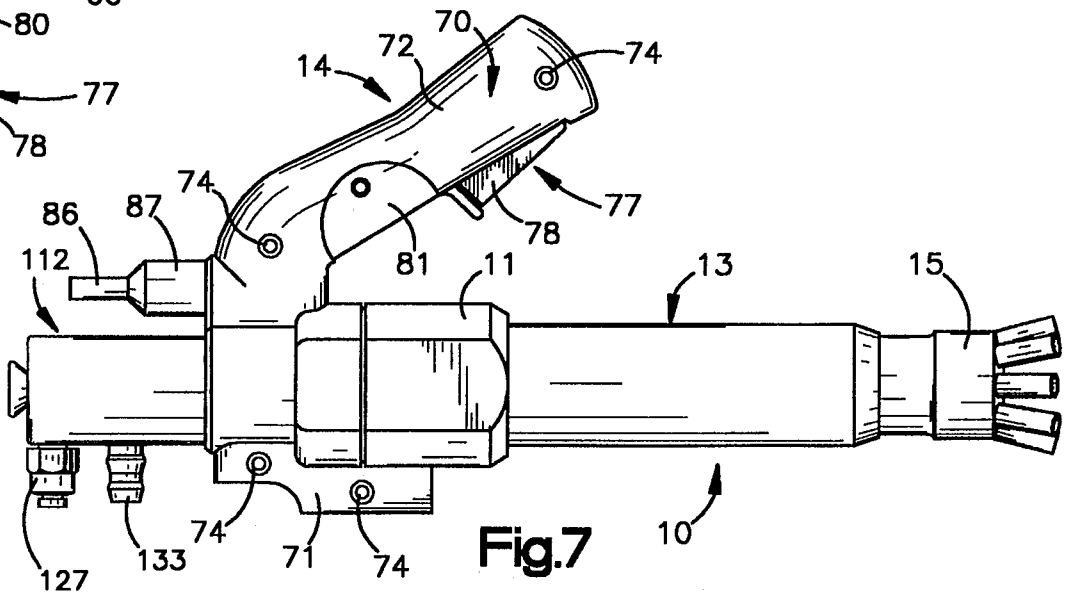
FIG. 7 is a side elevational view, similar to FIGS. 1 and 4, showing the powder spray gun with the wand handle of FIG. 1 and the diffuser of FIG. 4.

While the diffuser 112 is preferred with a spray gun having the pistol handle 114, it should be understood that the diffuser 112 can also be used with a spray gun having the wand handle 14 as shown in FIG. 7, and that the diffuser 12 can also be used with a spray gun having either handle 14 or 14. The diffuser 112 is preferred with a spray gun using the pistol handle 114 because the hose connections 127 and 133 are located at the bottom of the gun which makes the gun easier to handle when the gun is used in a raised position which is common for the pistol handle gun. The gun having the wand handle 14 is commonly used in a lowered position, so the diffuser 12 is preferred since the hose connections 27 and 33 are not located at the bottom of the diffuser, but instead are located at the rear of the gun.

While the invention has been shown and described with reference to a spray gun for powder coating, it should be understood that the invention can also be adopted and use in a liquid spraying operation.

Other variations and modifications of the specific embodiments herein shown and described will be apparent to those skilled in the art, all within the intended spirit and scope of the invention. While the invention has been shown and described with respect to particular embodiments thereof, these are for the purpose of illustration rather than limitation. Accordingly, the patent is not to be limited in scope and effect to the specific embodiments herein shown and described nor in any other way this is inconsistent with the extent to which the progress in the art has been advanced by the invention.

What is claimed is:

1. A hand-held powder spray gun which comprises:

a body having first and second ends;

a diffuser for mixing powder with conveying air, the diffuser connected to the first end of the body and forming the inlet end of the gun;

a barrel extending longitudinally along an axis from the second end of the body, the barrel providing a charging path for the powder;

a sprayhead mounted on the barrel opposite the body, the sprayhead forming the outlet end of the gun; and a wand handle for grasping and operating the gun, the handle being attached to the body and extending upwardly from the body, the wand handle including a cable connection located adjacent to the gun body and extending toward the inlet end of the gun.

2. The spray gun of claim 1, wherein the wand handle extends upwardly from the body and extends toward the outlet end of the gun.

3. The spray gun of claim 2, wherein the barrel and the wand handle form an acute angle with each other.

4. The spray gun of claim 1, wherein the wand handle is removable from the gun body.

5. The spray gun of claim 4, wherein the removable wand handle is capable of being replaced by a pistol handle.

6. The spray gun of claim 1, wherein the wand handle includes a trigger mounted at the upper end of the handle.

7. The spray gun of claim 1, wherein the diffuser includes a first hose connection for attachment to a powder coating material supply hose and a second hose connection for attachment to a conveying air supply hose, the first and second hose connections both extending from the end of the diffuser opposite the body, the first and second hose connections being substantially parallel to each other and substantially parallel to the longitudinal axis of the barrel of the gun.

8. The spray gun of claim 1, wherein the diffuser includes a first hose connection for attachment to a powder coating material supply hose and a second hose connection for attachment to a conveying air supply hose, the first and second hose connections being substantially parallel to each other and substantially perpendicular to the longitudinal axis of the barrel of the gun.

9. The spray gun of claim 8, wherein the wand handle is removable and is capable of being replaced by a pistol handle.

10. The spray gun of claim 1, wherein the barrel includes means for electrically charging the powder coating material as it flows therethrough, the charging means comprising an inner core positioned within a hollow outer cylinder, the charging surfaces of the inner core and the outer cylinder each being made of electrically insulating material, whereby the powder coating material is frictionally charged by repeated contact with the cylinder and the core during flow therethrough.

11. The spray gun of claim 10, wherein the outer cylinder has an inner dimension, the inner core has an outer dimension, an annular gap is formed between the outer cylinder and inner core providing a friction charging flowpath for the powder coating material, the outer dimension of the inner core and the inner dimension of the outer core each having a plurality of increases and decreases providing undulating charging surfaces, the outer dimension of the inner core increasing at generally the same longitudinal position that the inner dimension of the outer cylinder increases, the outer dimension of the inner core decreasing at generally the same longitudinal position that the inner dimension of the outer cylinder decreases, whereby the powder coating material is frictionally charged by repeated contact with the cylinder or the core during flow through the annular gap.

12. The spray gun of claim 10, further comprising a ground electrode located externally to the flow path of the powder coating material, the ground electrode comprising a ground ring around the exterior of the outer cylinder.

13. An assembly for converting the handle position of a hand-held spray gun for coating materials having a pistol handle assembly mounted to a gun body and extending downwardly from the gun body toward the rear of the gun, the pistol handle assembly including a pistol handle body, a trigger and a switch, the converting assembly comprising a wand handle assembly including a wand handle body for mounting to the gun body and extending upwardly from the gun body, means for mounting the trigger from the pistol handle body to the wand handle body, and means for mounting the switch from the pistol handle body to the wand handle body.

14. An assembly for converting the handle position of a hand-held spray gun for coating materials having a wand handle assembly mounted to a gun body and extending upwardly from the gun body, the wand handle assembly including a wand handle body, a trigger and a switch, the converting assembly comprising a pistol handle assembly including a pistol handle body for mounting to the gun body and extending downwardly from the gun body, means for mounting the trigger from the wand handle body to the pistol handle body, and means for mounting the switch from the wand handle body to the pistol handle body.

15. A hand-held spray gun for powder coating materials which comprises:

a body having first and second ends;

a barrel extending longitudinally along an axis from the second end of the body;

a sprayhead mounted on the barrel opposite the body, the sprayhead forming the outlet end of the gun;

a handle attached to the body for grasping and operating the gun, the handle including a cable connection located adjacent to the gun body and extending toward the first end of the gun body; and a diffuser for mixing powder coating material with conveying air, the diffuser being mounted at the first end of the body and forming the inlet end of the gun, the diffuser including a first hose connection for attachment to a powder coating material supply hose and a second hose connection for attachment to a conveying air supply hose, the first and second hose connections both extending from the end of the diffuser opposite the body, the first and second hose connections being substantially parallel to each other and substantially parallel to the longitudinal axis of the barrel of the gun.

16. The spray gun of claim 15, wherein the handle is a wand handle which extends upwardly from the body and extends toward the outlet end of the gun.

17. The spray gun of claim 16, wherein the wand handle includes a trigger mounted at the upper end of the handle.

18. The spray gun of claim 16, wherein the wand handle is removable and capable of being replaced with a pistol handle.

19. The spray gun of claim 15, wherein the handle is removable from the gun body.

20. A convertible hand held spray gun for coating materials, comprising:

a barrel having a rearward end and a forward end;

a sprayhead connected to the forward end of the barrel; and a kit comprising interchangeable pistol and wand handle bodies which are selectively mountable to the barrel, the pistol handle body being mountable with respect to the barrel to extend downwardly from the barrel, the wand handle body being mountable with respect to the barrel to extend upwardly from the barrel.

21. The spray gun of claim 20, wherein the wand handle body when mounted to the barrel extends toward the sprayhead, and the pistol handle body when mounted to the barrel extends away from the sprayhead.

22. The spray gun of claim 20, further comprising a gun body, the rearward end of the barrel being connected to the gun body, the interchangeable pistol and wand handle bodies being mounted with respect to the barrel by being mounted to the gun body.

23. The spray gun of claim 20, further comprising a trigger and a switch, the trigger and the switch being selectively mountable in either the wand handle body or the pistol handle body.

24. The spray gun of claim 20, wherein the pistol handle body is comprised of two pistol handle body members which are releasably securable together around the barrel, and wherein the wand handle body is comprised of two wand handle body members which are releasably securable together around the barrel.

25. The spray gun of claim 24, further comprising a trigger and a switch, the trigger and the switch being selectively mountable between either the wand handle body members or the pistol handle body members.

26. A method of converting a hand-held spray gun for coating materials between a wand style spray gun and a pistol style spray gun, which comprises the steps of providing a spray gun having a provided handle removably attached thereto, the provided handle being one of a wand handle and a pistol handle;

removing the provided handle from the gun; and replacing the provided handle with a replacement handle, the replacement handle being the other of the wand handle and the pistol handle.

27. The method of claim 26, wherein the spray gun is provided with the provided handle having a trigger and a switch, comprising the additional step of removing the trigger and the switch from the provided handle when the provided handle is removed from the gun, and installing the trigger and the switch in the replacement handle.

28. The method of claim 26, wherein the provided handle of the spray gun is formed of two handle body members releasably secured together, and the replacement handle is formed of two handle body members which are similar to the body members of the provided handle, and the step of replacing the provided handle with the replacement handle comprises:

removing the provided handle by removing the body members of the provided handle from the remainder of the spray gun, and securing the body members of the replacement handle of the spray gun.

* * * * *

UNITED STATES PATENT AND TRADEMARK OFFICE

CERTIFICATE OF CORRECTION

PATENT NO. : 5,395,046

DATED : March 7, 1995

INVENTOR(S) : Alan J. Knobbe et al.

It is certified that error appears in the above—identified patent and that said Letters Patent is hereby corrected as shown below:

Col. 1, line 14, "anitem" should be --an item--.

Col. 9, line 55, after "pistol handle" "14" should be --114--.

Col. 11, line 10, "14 or 14" should be --14 or 114--.

Col. 14, line 54, "handle of" should be --handle to--.

Signed and Sealed this

Thirtieth Day of May, 1995

Bruce Lehman

*Attest:*

BRUCE LEHMAN

*Attesting Officer*

*Commissioner of Patents and Trademarks*